US007832380B1

(12) United States Patent
Abou Zeid et al.

(10) Patent No.: US 7,832,380 B1
(45) Date of Patent: Nov. 16, 2010

(54) MARINE FUEL SYSTEM WITH AN ULLAGE CONTROL DEVICE

(75) Inventors: Amir Abou Zeid, Waupun, WI (US); Timothy S. Reid, Fond du Lac, WI (US); Troy J. Kollmann, Mt. Calvary, WI (US); Michael A. Torgerud, Mt. Calvary, WI (US); Brian L. Merten, St. Cloud, WI (US)

(73) Assignee: Brunswick Corporation, Lake Forest, IL (US)

( * ) Notice: Subject to any disclaimer, the term of this patent is extended or adjusted under 35 U.S.C. 154(b) by 103 days.

(21) Appl. No.: 12/361,112

(22) Filed: Jan. 28, 2009

(51) Int. Cl.
*F02M 33/04* (2006.01)
*F02M 33/02* (2006.01)

(52) U.S. Cl. ..... 123/519

(58) Field of Classification Search ..... 123/519, 123/520, 518, 517, 509, 456, 457; 137/565.01, 137/565.17, 565.29, 565.33, 571, 255; 440/88 F
See application file for complete search history.

(56) References Cited

U.S. PATENT DOCUMENTS

| | | | | |
|---|---|---|---|---|
| 4,844,043 | A | 7/1989 | Keller | |
| 4,848,283 | A | 7/1989 | Garms et al. | |
| 4,856,483 | A | 8/1989 | Beavis et al. | |
| 4,876,993 | A | 10/1989 | Slattery | |
| 5,389,245 | A | 2/1995 | Jaeger et al. | |
| 5,647,331 | A | 7/1997 | Swanson | |
| 5,832,903 | A | 11/1998 | White et al. | |
| 5,855,197 | A | 1/1999 | Kato | |
| 5,908,020 | A | 6/1999 | Boutwell et al. | |
| 5,915,363 | A | 6/1999 | Iwata et al. | |
| 6,006,705 | A | 12/1999 | Kato et al. | |
| 6,076,509 | A | 6/2000 | Kyuma | |
| 6,136,267 | A * | 10/2000 | Bergman | 422/41 |
| 6,216,672 | B1 | 4/2001 | Mishima et al. | |
| 6,253,742 | B1 | 7/2001 | Wickman et al. | |
| 6,257,208 | B1 | 7/2001 | Harvey | |
| 6,321,711 | B1 | 11/2001 | Kato | |
| 6,428,375 | B2 | 8/2002 | Takayanagi | |
| 6,553,974 | B1 | 4/2003 | Wickman et al. | |
| 6,575,145 | B2 | 6/2003 | Takahashi | |
| 6,679,229 | B2 | 1/2004 | Wada et al. | |
| 6,698,401 | B2 | 3/2004 | Suzuki et al. | |
| 6,918,380 | B2 | 7/2005 | Nomura | |
| 7,101,239 | B1 | 9/2006 | Torgerud et al. | |
| 7,112,110 | B1 * | 9/2006 | Kollmann | 440/88 F |
| 7,168,414 | B2 | 1/2007 | Harvey | |
| 7,178,512 | B1 | 2/2007 | Merten | |
| 7,401,598 | B2 | 7/2008 | Ochiai | |
| 2005/0155582 | A1 * | 7/2005 | Schelhas et al. | 123/497 |

* cited by examiner

*Primary Examiner*—Mahmoud Gimie
(74) *Attorney, Agent, or Firm*—William D. Lanyi

(57) ABSTRACT

A marine engine fuel system provides a low pressure lift pump to draw fuel from a fuel tank and cause the fuel to flow into a reservoir and a high pressure fuel pump which draws fuel from the reservoir and provides it to a fuel rail. An inlet conduit of the high pressure fuel pump is provided with a primary and a secondary opening. The secondary opening can be an orifice formed through a wall of the inlet conduit. The secondary opening is positioned, relative to the primary opening, at a location which assists in controlling the fuel level within the reservoir and the quantity of gaseous fuel contained within an ullage above the liquid pool of fuel.

20 Claims, 5 Drawing Sheets

MARINE FUEL SYSTEM WITH AN ULLAGE CONTROL DEVICE

BACKGROUND OF THE INVENTION

1. Field of the Invention

The present invention is generally related to a marine fuel system and, more particularly, to a fuel system that provides primary and secondary openings in a fuel conduit to allow fuel vapor to be removed from the cavity of a fuel reservoir.

2. Description of the Related Art

Those skilled in the art of marine propulsion systems are aware of many different types of fuel systems. Some fuel systems use fuel vapor separators which are vented while others use unvented reservoirs. Some systems incorporate lift pumps and high pressure pumps within the structure of a fuel reservoir while others place these pumps outside the fuel reservoir. Certain marine propulsion systems use separate pumps to lift fuel from a fuel tank and to pressurize the fuel and induce it to flow to a fuel injection system. In all types of marine propulsion systems, it is beneficial to control the accumulation of fuel vapor within the system and to moderate the temperature of the fuel under a wide variety of circumstances.

U.S. Pat. No. 4,844,043, which issued to Keller on Jul. 4, 1989, describes an anti-vapor lock carbureted fuel system. It includes a first crankcase pressure driven fuel pump supplying fuel from a remote fuel tank to a vapor separator, and a second crankcase pressure driven fuel pump supplying vapor free fuel from the vapor separator to the carburetors of the engine. In combination, a squeeze bulb and one-way check valve supply fuel from the remote fuel tank directly to the carburetors for starting the engine.

U.S. Pat. No. 4,848,283, which issued to Garms et al. on Jul. 18, 1989, discloses a marine engine with combination vapor return, crankcase pressure, and cooled fuel line conduit. A marine propulsion system includes a two-cycle water cooled crankcase compression internal combustion engine including a vapor separator, a remote fuel tank, and a fuel pump in the tank for delivering fuel to the engine in response to crankcase pulse pressure. A combination conduit between the fuel tank and the engine includes a first passage communicating crankcase pulse pressure from the engine to the fuel pump in the tank, a second passage supplying fuel from the pump in the tank to the engine, a third passage returning fuel vapor from the vapor separator at the engine back to the tank, a fourth passage supplying cooling water from the engine towards the tank, and a fifth passage returning water from the fourth passage back to the engine.

U.S. Pat. No. 4,856,483, which issued to Beavis et al. on Aug. 15, 1989, discloses a vacuum bleed and flow restrictor fitting for fuel injected engines with vapor separators. The fitting is provided in the vapor supply line. The fitting has a first reduced diameter passage providing a vacuum bleed orifice passage partially venting vacuum from the induction manifold to atmosphere, to limit peak vacuum applied to the vapor separator from the induction manifold. The fitting has a second reduced diameter passage providing a flow restrictor passage limiting the volume of flow of fuel vapor from the vapor separator to the induction manifold.

U.S. Pat. No. 4,876,993, which issued to Slattery on Oct. 31, 1989, discloses a fuel system with a vapor bypass of oil-fuel mixer halting oil pumping. The fuel delivery system has a vapor separator connected to prevent excess oil in the mixture as fuel runs out. The vapor separator has a fuel inlet receiving fuel from the tank, a fuel outlet delivering fuel to the fuel inlet of the oil-fuel mixer, and a vapor outlet delivering vapor or air through a bypass connection to the suction intake side of a fuel pump and bypassing the mixer.

U.S. Pat. No. 5,389,245, which issued to Jaeger et al. on Feb. 14, 1995, discloses a vapor separating unit for a fuel system. It has particular application to a fuel system for a marine engine. The vapor separating unit includes a closed tank having a fuel inlet through which fuel is fed to the tank by a diaphragm pump. The liquid level in the tank is controlled by a float-operated valve. An electric pump is located within the vapor separating tank and has an inlet disposed in the tank and an outlet connected to a fuel rail assembly of the engine.

U.S. Pat. No. 5,647,331, which issued to Swanson on Jul. 15, 1997, describes a liquid cooled fuel pump and vapor separator. The fuel pump is housed in an aluminum body module formed by two iso-pods open end to open end to provide a multi-cavity module housing of heat conductive material. The pump inlet faces downwardly in one of the cavities and a small clearance volume directly surrounds the pump casing which, in one embodiment, is filled with liquid fuel and in another with cooling water.

U.S. Pat. No. 5,832,903, which issued to White et al. on Nov. 10, 1998, discloses a fuel supply system for an internal combustion engine. It has an electronically controlled fuel injection system which eliminates the need for a vapor separator. The system pumps an excessive amount of fuel through a plumbed fuel supply loop and cools recirculated fuel to cool all the components in the plumbed fuel supply loop. Recirculated fuel flows from the pressure regulator to the water separating fuel filter as does make-up fuel from a fuel tank. The fuel stream from the water separating fuel filter flows to the low pressure side of the fuel pump which pumps the fuel through the plumb fuel supply loop.

U.S. Pat. No. 5,855,197, which issued to Kato on Jan. 5, 1999, describes a vapor separator for fuel injected engines. A compact vapor separator for a fuel injection system reduces the size of the fuel system mounted on the side of an outboard engine. The girth of the outboard motor's power head consequently is decreased. In one embodiment, the vapor separator employs a plurality of rotary vein type pumps. The pumps are sized to produce a sufficient flow rate and fuel pressure, while minimizing power consumption.

U.S. Pat. No. 5,908,020, which issued to Boutwell et al. on Jun. 1, 1999, describes a marine fuel pump and cooling system. It comprises a fuel pump, a fuel filter axially mounted directly below and around the lower portion of the fuel pump, and a spiral-wound fuel line composed of a heat conductive material mounted concentric to the upper portion of the fuel pump, minimizing the space required for installation.

U.S. Pat. No. 5,915,363, which issued to Iwata et al. on Jun. 29, 1999, describes a fuel supply system for an engine powering an outboard motor. The system includes a pump for supplying fuel from a tank to a vapor separator. Another pump delivers fuel from the vapor separator to at least one charge former for supplying fuel to the combustion chambers of the engine. The fuel supply system includes a mechanism for reducing the transmission of vapor to the pump which delivers fuel to the charge formers.

U.S. Pat. No. 6,006,705, which issued to Kato et al. on Dec. 28, 1999, describes a fuel injection system. It includes a main fuel source and a pump for delivering fuel from the main fuel source through a fuel filter to a vapor separator. Fuel is supplied from the chamber by a high pressure pump through a fuel rail to one or more fuel injectors. Undelivered fuel is returned to the vapor separator through a return line.

U.S. Pat. No. 6,076,509, which issued to Kyuma on Jun. 20, 2000, describes a fuel supply apparatus of an outboard motor. It comprises a vapor separator for removing bubbles in the fuel, a float type bubble discharge valve which is provided for the vapor separator and adapted to be closed when a fuel level in a fuel tank rises, and a negative pressure opening type valve connected to a downstream side of the bubble discharge valve so as to be opened upon reception of an intake negative pressure of the engine.

U.S. Pat. No. 6,216,672, which issued to Mishima et al. on Apr. 17, 2001, describes a fuel supply system of an outboard motor. It comprises a fuel tank in which a fuel is stored, a low pressure fuel filter and a low pressure fuel pump connected to the fuel tank through a fuel supply hose, a vapor separator connected to the low pressure fuel pump through a low pressure fuel hose, a high pressure fuel pump disposed inside the vapor separator, a pressure regulator disposed inside the vapor separator, a fuel hose having one end connected to the high pressure fuel pump, and a branch pipe incorporated on the way of the fuel hose and having one end connected to the pressure regulator.

U.S. Pat. No. 6,253,742, which issued to Wickman et al. on Jul. 3, 2001, discloses a fuel supply method for a marine propulsion engine. It uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

U.S. Pat. No. 6,257,208, which issued to Harvey on Jul. 10, 2001, describes a marine vapor separator. A method of controlling fuel temperature while supplying fuel from a fuel tank to an array of fuel injectors of an internal combustion engine comprises the steps of pumping the fuel with a high pressure pump, flowing the fuel through a fuel line from the fuel tank to the high pressure pump, and flowing the fuel through a vapor separator in the fuel line between the tank and the high pressure pump.

U.S. Pat. No. 6,321,711, which issued to Kato on Nov. 27, 2001, describes a fuel supply system for a direct injected outboard engine. It includes a pump for supplying fuel from a tank to a vapor separator. An electrical pump delivers fuel from the vapor separator to a mechanical high pressure pump, which delivers fuel under high pressure to a fuel manifold and further to a pair of fuel rails. The fuel rails supply fuel to fuel injectors for delivering fuel to the combustion chambers of the engine.

U.S. Pat. No. 6,428,375, which issued to Takayanagi on Aug. 6, 2002, describes a fuel cooling apparatus of an outboard motor. It has a vapor separator, a fuel injector positioned to supply a fuel from the vapor separator into the engine, a high pressure fuel pump positioned in the vapor separator to feed the fuel under pressure to the fuel injector, and a pressure regulator positioned in the vapor separator to reduce a pressure of a return fuel, the fuel cooling apparatus including a fuel cooler having fuel and cooling water passages arranged side by side.

U.S. Pat. No. 6,553,974, which issued to Wickman et al. on Apr. 29, 2003, discloses an engine fuel system with a fuel vapor separator and a fuel vapor vent canister. The system provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber.

U.S. Pat. No. 6,575,145, which issued to Takahashi on Jun. 10, 2003, describes a fuel supply system for a four cycle outboard motor. It includes a fuel injection system that includes a fuel pump, a plurality of fuel injectors, a fuel pump and a vapor separator. The vapor separator is in communication with a fuel pump and at least one fuel return line. The vapor separator includes a vent for removing vapors from the fuel. The vapor separator also includes a canister positioned within the vapor separator below the vent. The canister includes hydrocarbon absorption media.

U.S. Pat. No. 6,679,229, which issued to Wada et al. on Jan. 20, 2004, describes a fuel supply apparatus for an outboard engine. To improve a freedom of layout within a narrow cowling of an outboard engine, achieve a reduction of manufacturing costs and an improvement of a maintenance performance of a fuel filter, a fuel supply apparatus in an outboard engine is structured such that fuel within a fuel tank is supplied into a vapor separator via a to low pressure fuel pump.

U.S. Pat. No. 6,698,401, which issued to Suzuki et al. on Mar. 2, 2004, describes a fuel supply control system for an outboard motor. It regulates the fuel pressure to a vapor separator in a fuel injection system by using a pressure relief valve that returns excess fuel to the intake of the fuel pump. In order to permit excess fuel flow without substantial excess in low speeds, the fuel pump speed is regulated depending upon engine speed, fuel temperature, and fuel pressure.

U.S. Pat. No. 6,918,380, which issued to Nomura on Jul. 19, 2005, describes a fuel injection apparatus for a marine engine. To provide a fuel injection apparatus preferable for a marine engine which can prevent a metal soap from being generated in a motor portion of a high pressure electric pump even when fuel containing sea water is sucked into the electric pump, a high pressure electric pump is provided with a pump portion and a motor portion within a pump housing, the pump portion sucks fuel within a vapor separator, high pressure fuel the pressure of which has been increased by the pump portion is discharged through a periphery of the pump portion.

U.S. Pat. No. 7,101,239, which issued to Torgerud et al. on Sep. 5, 2006, discloses a fuel filter located below an adapter plate of an outboard motor. A marine propulsion device is provided with a fuel filter that is connectable between a fuel tank and a fuel pump, wherein the fuel filter is disposed below an adapter plate of the marine propulsion device. The adapter plate is located between the fuel filter and the engine so that the fuel filter is not located under the cowl of the marine propulsion device where an engine is housed.

U.S. Pat. No. 7,168,414, which issued to Harvey on Jan. 30, 2007, describes a marine vapor separator with a bypass line. Liquid fuel is to supplied to a marine engine from a fuel tank. The fuel first passes through a water filter, a lift pump and is temporarily deposited in a vapor separator where vapors given off from the fuel are collected and vented. A high pressure pump withdraws liquid fuel from the vapor separator and delivers it under pressure to an engine injection system via a fuel delivery line.

U.S. Pat. No. 7,178,512, which issued to Merten on Feb. 20, 2007, discloses a fuel system for a marine vessel with a gaseous purge fuel container. A fuel container for a marine propulsion system is provided with a pump and a hose connected to an outlet of the pump and disposed within the cavity of the fuel container. The hose is provided with an opening, formed through its wall, through which a fluid can flow under certain circumstances. The opening is disposed in an ullage within the container and allows gaseous elements to be purged from the container when flow is induced from the container back to a fuel reservoir.

U.S. Pat. No. 7,401,598, which issued to Ochiai on Jul. 22, 2008, describes an outboard motor with forward air intake and air cooled fuel pump. It comprises a cowling for covering an engine, a high pressure fuel supply system, and a low pressure fuel supply system. The high pressure fuel supply system can have a vapor separator tank and a high pressure fuel pump. The low pressure fuel supply system can have a low pressure fuel pump. A heat insulating chamber, defined from a space for accommodating the engine, can be formed within the cowling. The heat insulating chamber houses the low pressure fuel pump and the fuel filter.

The patents described above are hereby expressly incorporated by reference in the description of the present invention.

As described above, many different types of fuel supply systems are known to those skilled in the art. It is important to control the temperature of fuel that is drawn from a fuel tank and supplied to an engine located under the cowl of an outboard motor. It is also necessary to control the accumulation of fuel vapor within the conduits and reservoirs of the fuel system. It would therefore be significantly beneficial if a relatively simple system could be provided which controls the amount of gaseous fuel vapor contained within a fuel reservoir, which moderates the temperature of stored fuel within the reservoir or which is recirculated by its associated fuel pumps, and which separates fuel circulated by one fuel pump from fuel circulated by the other fuel pump.

SUMMARY OF THE INVENTION

Various embodiments of the present invention will be described below. Preferred embodiments of the present invention provide a marine engine fuel system which comprises a reservoir configured to contain a quantity of fuel, a first fuel pump having a first inlet and a first outlet, a first inlet conduit connected in fluid communication with the first inlet, a second fuel pump having a second inlet and a second outlet, and a second inlet conduit connected in fluid communication with the second inlet.

In one embodiment of the present invention, a primary opening is foamed in the second inlet conduit and a secondary opening is formed in the second inlet conduit. The primary and secondary openings are disposed within the reservoir, with the secondary opening being disposed at a higher elevation than the primary opening. In certain embodiments of the present invention, the first and second fuel pumps are disposed within the reservoir and at least partially submerged within the quantity of fuel. The first inlet conduit can be connected in fluid communication with a fuel tank of a marine vessel and the first outlet can be connected in fluid communication with the reservoir. The second inlet conduit can be connected in fluid communication with the reservoir and the second outlet can be connected in fluid communication with a fuel rail of a marine engine. In one preferred embodiment of the present invention, the primary opening is located at a distal end of the second inlet conduit and the secondary opening is an orifice located between the primary opening and the second inlet. In a particularly preferred embodiment of the present invention, the second inlet conduit is positioned to dispose the primary opening within liquid fuel and to dispose the secondary opening within vaporous fuel when both liquid and vaporous fuel exist within the reservoir. In certain embodiments of the present invention, the second inlet conduit is positioned to dispose the primary opening closer to the second outlet than to the second inlet.

In one preferred embodiment of the present invention, it comprises a water pump and a first heat exchanger having a first water circuit which is connected in fluid communication with the water pump and disposed in thermal communication with a first fuel circuit. It also can comprise a second heat exchanger having a second water circuit which is connected in fluid communication with the water pump and disposed in thermal communication with a second fuel circuit. The second fuel pump can be connected in fluid communication with the second fuel circuit and the first fuel pump can be connected in fluid communication with the first fuel circuit. In a particularly preferred embodiment of the present invention, the second water circuit is disposed in thermal communication between the second fuel circuit and the quantity of fuel within the reservoir and the first water circuit is disposed in thermal communication between the first fuel circuit and the quantity of fuel within the reservoir.

In a particularly preferred embodiment of the present invention, the fuel system is configured to inhibit fuel from flowing into the first inlet after it has flowed into the quantity of fuel within the reservoir and to inhibit fuel from flowing into the quantity of fuel within the reservoir after it has flowed out of the second outlet. The first and second heat exchangers can be disposed within the quantity of fuel within the reservoir.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
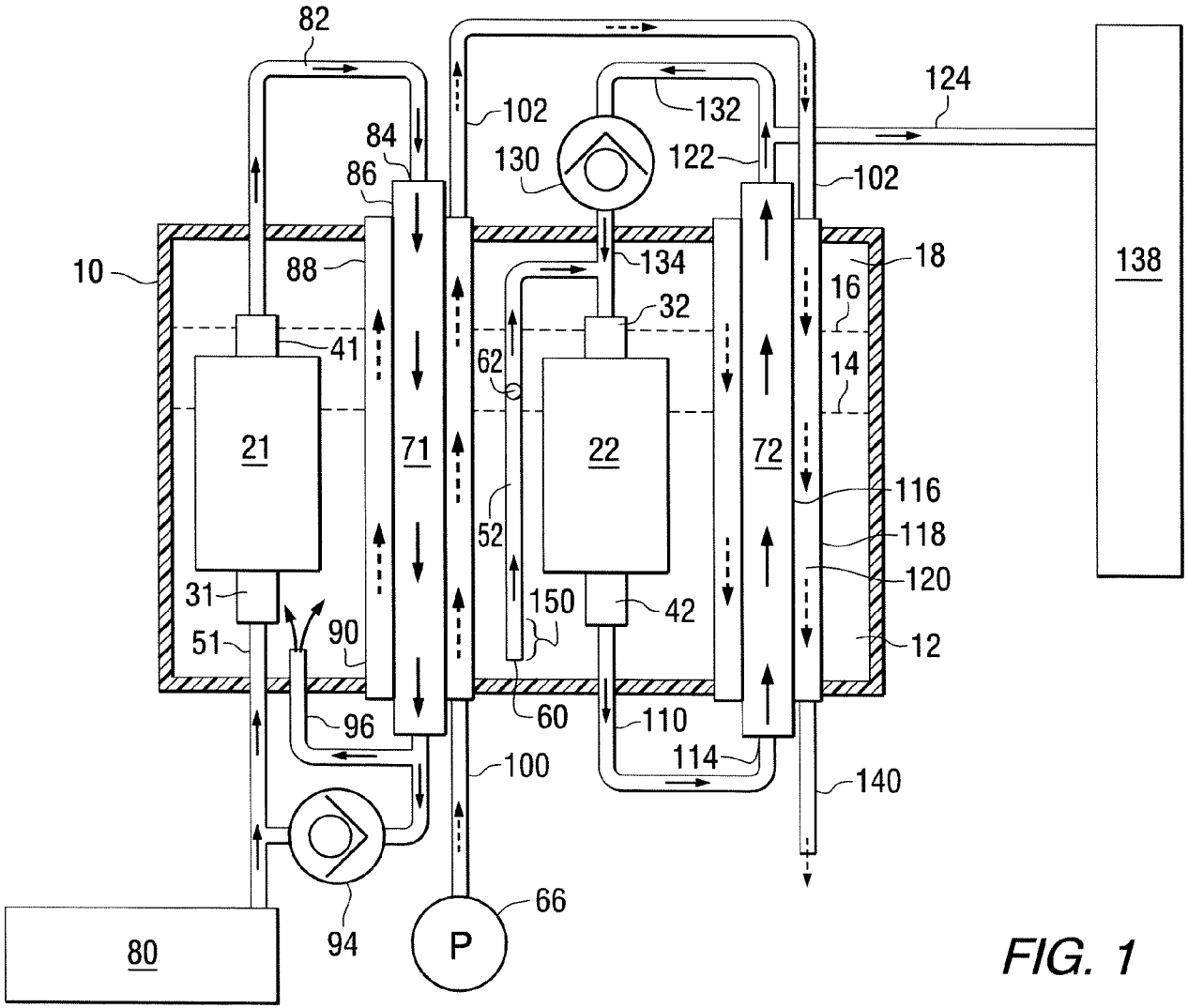
FIG. 1 is a schematic representation of a fuel system incorporating several concepts of a preferred embodiment of the present invention.

Throughout the description of the preferred embodiment of the present invention, like components will be identified by like reference numerals.

FIG. 1 is a schematic representation of a fuel system for a marine engine made in accordance with a preferred embodiment of the present invention. It is intended to illustrate several of the advantageous concepts embodied in applications of the present invention. The fuel system comprises a reservoir 10 which is configured to contain a quantity of fuel 12. As will be described in greater detail below, two dashed lines, 14 and 16, are used to represent two different hypothetical fuel levels which separate the liquid fuel from the ullage 18 above the liquid fuel. A preferred embodiment of the present invention further comprises a first fuel pump 21 having a first inlet 31 and a first outlet 41. A first inlet conduit 51 is connected in fluid communication with the first inlet 31. A preferred embodiment of the present invention further comprises a second fuel pump 22 having a second inlet 32 and a second outlet 42. A second inlet conduit 52 is connected in fluid communication with the second inlet 32. A primary opening 60 is formed in the second inlet conduit 52. A secondary opening 62 is also formed in the second inlet conduit 52. The primary and secondary openings, 60 and 62, are disposed within the reservoir 10. The secondary opening 62 is disposed at a higher elevation than the primary opening 60.

With continued reference to FIG. 1, a preferred embodiment of the present invention further comprises a water pump 66, a first heat exchanger 71 and a second heat exchanger 72. The first heat exchanger 71 has a first water circuit which is connected in fluid communication with the water pump 66 and disposed in thermal communication with a first fuel circuit. The first water circuit and the first fuel circuit will be described in greater detail below. The second heat exchanger 72 has a second water circuit which is connected in fluid communication with the water pump and disposed in thermal communication with a second fuel circuit. The first fuel pump 21 is connected in fluid communication with the first fuel circuit and the second fuel pump 22 is connected in fluid communication with the second fuel circuit.

With continued reference to FIG. 1, the first fuel pump 21 draws fuel from a fuel tank 80 through the first inlet conduit 51 and causes the fuel to flow through conduit 82 to a fuel inlet 84 of the first heat exchanger 71. The fuel, in a particularly preferred embodiment of the present invention, flows through an inner tube 86 which is disposed within an outer tube 88 which contains a flowing volume of water in the annular space 90 between the inner and outer tubes, 86 and 88. A pressure regulator 94 maintains the pressure in conduit 96 at approximately 70 kPa in a preferred embodiment of the present invention. If the pressure exceeds the regulated pressure, the regulator 94 directs fuel back to the first inlet conduit 51 for recirculation by the first fuel pump 21 through the first heat exchanger 71.

The water pump 66 draws water from a body of water in which the marine propulsion system is used and causes that water to flow through conduit 100 and the annular space 90 between the inner and outer tubes, 86 and 88, of the first heat exchanger 71. This water flows upwardly through the space 90 and away from the first heat exchanger 71 through conduit 102. The fuel flowing out of conduit 96 into the reservoir 10 is regulated at approximately 70 kPa.

With continued reference to FIG. 1, the second fuel pump 22 draws fuel from the quantity of fuel 12 within the reservoir 10 and causes it to flow downwardly and through conduit 110 to an inlet 114 of the second heat exchanger 72. The second heat exchanger 72 comprises an inner tube 116 and an outer tube 118 which are configured to provide the annular space 120 therebetween. The fuel flows upwardly through the inner tube 116 and through conduits 122 and 124. Regulator 130 maintains the pressure within conduits 132, 122, and 124 at approximately 350 kPa. Excess fuel is conducted through conduit 134 back to the inlet 32 of the second pump 22. Water flowing through conduit 102, from the first heat exchanger 71, is directed to the annular space 120 and then through an outlet tube 140 to be returned to the body of water from which it was originally drawn by pump 66.

With continued reference to FIG. 1, several characteristics of a preferred embodiment of the present invention can be seen. First, the first and second fuel pumps, 21 and 22, are both disposed within the reservoir 10. The first inlet conduit 51 is connected in fluid communication with the fuel tank 80 of a marine vessel and the first outlet 41 is connected in fluid communication with the reservoir 10. The second inlet conduit 52 is connected in fluid communication with the quantity of fuel 12 within the reservoir 10 and the second outlet 42 is connected in fluid communication with the fuel rail 138 through the second heat exchanger 72. The primary opening 60 is located at a distal end 150 of the second inlet conduit 52 and the secondary opening 62, which is an orifice in a preferred embodiment of the present invention, is located between the primary opening 60 and the second inlet 32. The second inlet conduit 52 is positioned to dispose the primary opening 60 within the liquid fuel 12 and to dispose the secondary opening 62 in fluid communication with vaporous fuel in the ullage 18 when both liquid and vaporous fuel exist in sufficient quantities within the reservoir 10. In a preferred embodiment of the present invention, the secondary opening 62 is an orifice having a diameter of approximately 0.036 inches. The primary opening 60 is larger and, in a typical application of the present invention, is equal to the inner diameter of the second inlet conduit 52 which is approximately 0.25 inches. In certain embodiments of the present invention, the physical location of the secondary opening 62, in relation to the primary opening 60, is important because it serves as a factor in the determination of the fuel level (e.g. 14 or 16) within the reservoir 10. As is apparent to those skilled in the art, several factors affect the level of the liquid fuel 12 within the reservoir 10. Naturally, the pumping capacities of the first and second fuel pumps, 21 and 22, the demand for fuel by the fuel rail 138, and the fluid dynamics of the fuel flowing through the numerous conduits, pumps, and heat exchangers will affect the position of the fuel level (e.g. 14 or 16) within the reservoir 10. However, an important factor in the determination of the size of the ullage 18 relative to the size of the liquid fuel pool 12 is the position of the secondary opening 62 relative to the reservoir 10 and relative to the primary opening 60. The orifice 62 is smaller than the size of the primary opening 60 and it draws gaseous vapor much more readily than liquid fuel. If the secondary opening 62 is within the ullage 18, it will tend to draw vaporous fuel from the ullage more readily than liquid fuel is drawn through the primary opening 60. This result is due to the fact that a gaseous fuel vapor is much more easily drawn into the second inlet conduit 52 by the second fuel pump 22 than liquid fuel is drawn upwardly through the second inlet 52. As a result, the orifice of the secondary opening 62 serves to control the size of the ullage 18 and the position of the fuel level, 14 or 16, within the reservoir 10. It has been determined that it is beneficial to control the amount of vaporous fuel within the ullage 18 in order to assure a consistent and reliable flow of liquid fuel through conduit 124 to the fuel rail 138. However, it has also been determined that it is beneficial to provide some minimal amount of vaporous fuel in the ullage 18 and prevent the reservoir 10 from being completely filled with liquid fuel. The location of the orifice of the secondary opening 62 allows this control to be maintained. Naturally, it should be understood that the position of the orifice of the secondary opening 62 and its size in relation to the primary opening 60 can vary significantly from one application of the present invention to another. In a particularly preferred embodiment of the present invention, the second inlet conduit 52 is positioned to dispose the primary opening 60 closer to the second outlet 42 of the second fuel pump 22 than to the second inlet 32. In other words, in a preferred embodiment of the present invention, the second fuel pump 22 is positioned in such a way that it causes the flow of fuel in a downward direction, draws fuel through the primary opening 60 at a region near the bottom of the reservoir 10, and maintains the size of the ullage 18 through the advantageous positioning of the secondary opening 62. Those skilled in the art of marine fuel systems will appreciate the fact that the second fuel pump 22 need not always be configured to pump fuel in a downward direction. Similarly, the first fuel pump 21 need not pump fuel in an upward direction in all embodiments of the present invention. Similarly, the first and second fuel pumps, 21 and 22, need not be disposed within the reservoir 10 in all applications of the present invention.

With continued reference to FIG. 1, it can be seen that the first water circuit of the first heat exchanger 71 comprises conduit 100, the annular space 90, and the initial portion of conduit 102. It is connected in fluid communication with the water pump 66 and is disposed in thermal communication with a first fuel circuit that comprises the inside of the inner tube 86, conduit 82, the first fuel pump 21, and conduit 96. As described above, the pressure regulator 94 also allows a certain quantity of fuel to be recirculated back to the first inlet conduit 51 and the first inlet 31 of the first fuel pump 21. The second water circuit comprises conduit 102, the annular space 120 between the inner 116 and outer 118 tubes of the second heat exchanger 72 and conduit 140 which returns the water back to the body of water from which it was drawn. The water drawn by the pump 66 is induced to flow upwardly through the first heat exchanger 71 and then downwardly through the second heat exchanger 72. This provides two counter flow heat exchangers since the fuel flows downwardly through the first heat exchanger 71 and upwardly through the second heat exchanger 72. In FIG. 1, solid line arrows represent the flow of fuel and dashed line arrows represent the flow of water. As will be described in greater detail below, the first and second heat exchangers, 71 and 72, provide a significant benefit when they are disposed within the reservoir 10 as in a preferred embodiment of the present invention. The water flowing through the annular spaces, 90 and 120, of the first and second heat exchangers, 71 and 72, removes heat from both the inner tubes, 86 and 116, respectively, and from the quantity of fuel 12 within the reservoir 10. This is illustrated in more detail in FIG. 2.

Figure 2:
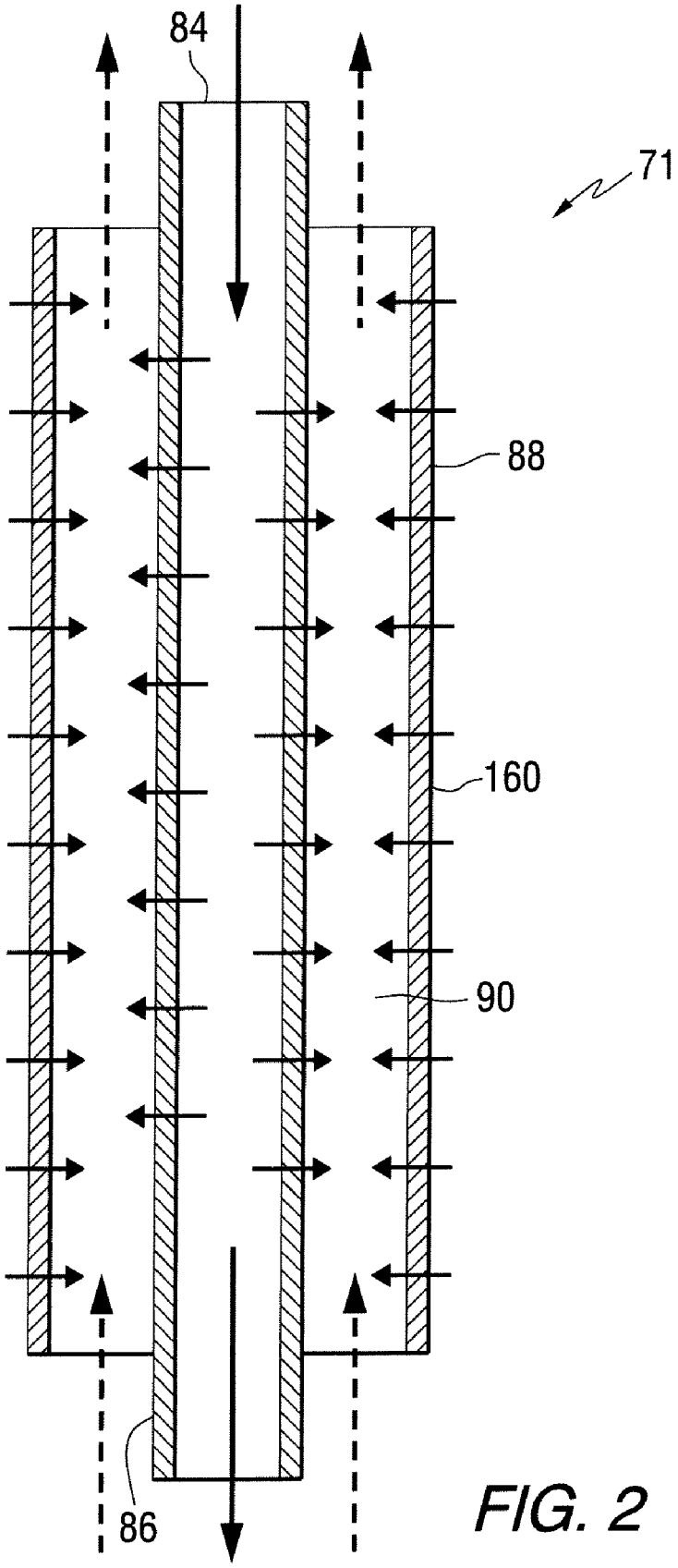
FIG. 2 is an isolated enlarged view of one heat exchanger used in a preferred embodiment of the present invention.

FIG. 2 is an isolated view of the first heat exchanger 71. Although not specifically indentified in FIG. 2, it should be understood that the liquid fuel 12, described above in conjunction with FIG. 1, is in contact with a significant portion of the outer surface 160 of the outer tube 88. The larger solid line arrows in FIG. 2 illustrate the flow of fuel into the inlet 84 and downwardly through the inner tube 86. The larger dashed line arrows in FIG. 2 illustrate the flow of water upwardly through the annular space 90 between the inner and outer tubes, 86 and 88. The smaller horizontal arrows are used to illustrate the directions of heat flow.

With reference to FIGS. 1 and 2, heat from the liquid fuel 12 in the reservoir 10 flows radially inwardly through the walls of the outer tube 88 toward the colder water flowing upwardly through the annular space 90 of the first heat exchanger 71. As a result, the continual flow of water through this annular space 90 removes heat from the fuel 12 stored within the reservoir 10. In addition, heat is conducted in a radially outward direction through the wall of the inner tube 86 and into the stream of water flowing through the annular space 90. This removes heat from the fuel flowing in the first fuel circuit described above. As some of the fuel is recirculated through the first fuel circuit and through the regulator 94, it can be heated because it is continually moved by the operation of the first pump 21. This heat is removed through the walls of the inner tube 86. The liquid fuel 12 within the reservoir 10 can absorb heat from surrounding components of the engine of a marine propulsion system and, as a result, its temperature can be increased. The first heat exchanger 71 removes this heat from the pool of liquid fuel 12 in the reservoir 10 by absorbing calories through the wall of the outer tube 88. It should be understood that although FIG. 2 only shows the heat exchanger 71, the basic principles described above apply equally to the second heat exchanger 72. Both of them are intended to absorb heat radially inwardly from the pool of liquid fuel 12 and radially outwardly from the fuel flowing through their respective fuel circuits and through their respective inner tubes, 86 and 116.

With continued reference to FIG. 1, another important characteristic of the present invention can be seen. The fuel system of a preferred embodiment of the present invention is configured to inhibit fuel from flowing into the first inlet 31 of the first pump 21 after it has flowed into the quantity of fuel 12 within the reservoir 10. Although, as described above, the first fuel circuit of the first fuel pump 21 recirculates fuel through the regulator 94, it should be understood that fuel does not return to the first inlet 31 of the first fuel pump 21 once it is conducted into the pool of liquid fuel within the reservoir 10. As a result, the fuel of the quantity of fuel 12 within the reservoir 10 is not pumped again after it is initially conducted into the reservoir. In addition, the fuel system of a preferred embodiment of the present invention is configured to inhibit fuel from flowing into the quantity of fuel 12 within the reservoir 10 after it has flowed out of the second outlet 42 of the second pump 22. This is true even though, as described above, fuel is recirculated through the regulator 130 within the second fuel circuit. As a result, the pool of liquid fuel within the reservoir 10 is, essentially, isolated from both the first and second fuel circuits of the first and second pumps, 21 and 22. The fuel that flows into the quantity of liquid fuel 12 from the first pump 21 does not return to the first fuel circuit after this has occurred. In addition, fuel drawn from the pool of liquid fuel 12 by the second pump 22 does not return to the quantity of liquid fuel 12 subsequently. This isolation between the first and second fuel circuits serves to reduce the amount of heat put back into the pool of liquid fuel by the pumps. Although both the first and second fuel pumps continually recycle fuel through their first and second fuel circuits, respectively, that recirculating fuel is immediately cooled as it flows through the inner tubes, 86 and 116, of the first and second heat exchangers, 71 and 72, respectively.

The basic principles of a preferred embodiment of the present invention serve to improve the fuel system of a marine engine in numerous ways. Not all of these characteristics are required in every embodiment of the present invention, but they are all intended to serve beneficial purposes. For example, the use of two heat exchangers is significantly beneficial in maintaining the temperature of the fuel within the fuel system. In addition, the arrangement shown in FIG. 1 allows both heat exchangers to be counter flow heat exchangers which improve their efficiency. In a preferred embodiment of the present invention, both heat exchangers are disposed within the reservoir 10 in order to allow heat to be removed simultaneously from both the pool of liquid fuel 12 and through the first and second fuel circuits. In addition, a preferred embodiment of the present invention places both the first and second fuel pumps within the reservoir 10. The respective locations of the primary 60 and secondary 62 openings within the second inlet conduit 52 allows for the control of the desired fuel level, 14 or 16, and the limitation of the quantity of vaporous fuel within the ullage 18. In addition, as will be described in detail below in conjunction with FIG. 3, the overall configuration of the present invention allows an efficient and compact packaging of the two fuel pumps and two heat exchangers within a common reservoir housing.

The position of the secondary opening 62, relative to the top of the interior portion of the reservoir 10, will determine the size of the ullage in combination with other variables relating to the sizes, configurations, and relative positions of other components of the fuel system. The location of the upper surface of the liquid fuel, which is hypothetically represented by dashed lines 14 and 16, will vary as a function of dimension h (illustrated in FIGS. 4 and 5) which will be to described below. However, it should be clearly understood that the size of the ullage relative to the volume of liquid fuel within the reservoir 10 is also a function of the pressure and temperature of the fuel within the reservoir, the rate at which fuel is provided to the fuel rail 138, the rate at which the fuel is drawn from the fuel tank 80, the relative flow rates through the various conduits of the fuel system, and the operating characteristics of the various regulators and check valves within the fuel system as will be described in greater detail below in conjunction with FIGS. 4 and 5. It should also be understood that although the magnitude of dimension h is important in determining the position of the upper surface of liquid fuel (e.g. dashed lines 14 or 16, hypothetically), the size of the ullage is also dependent on several other dimensions, positions, and operational characteristics.

Figure 3:
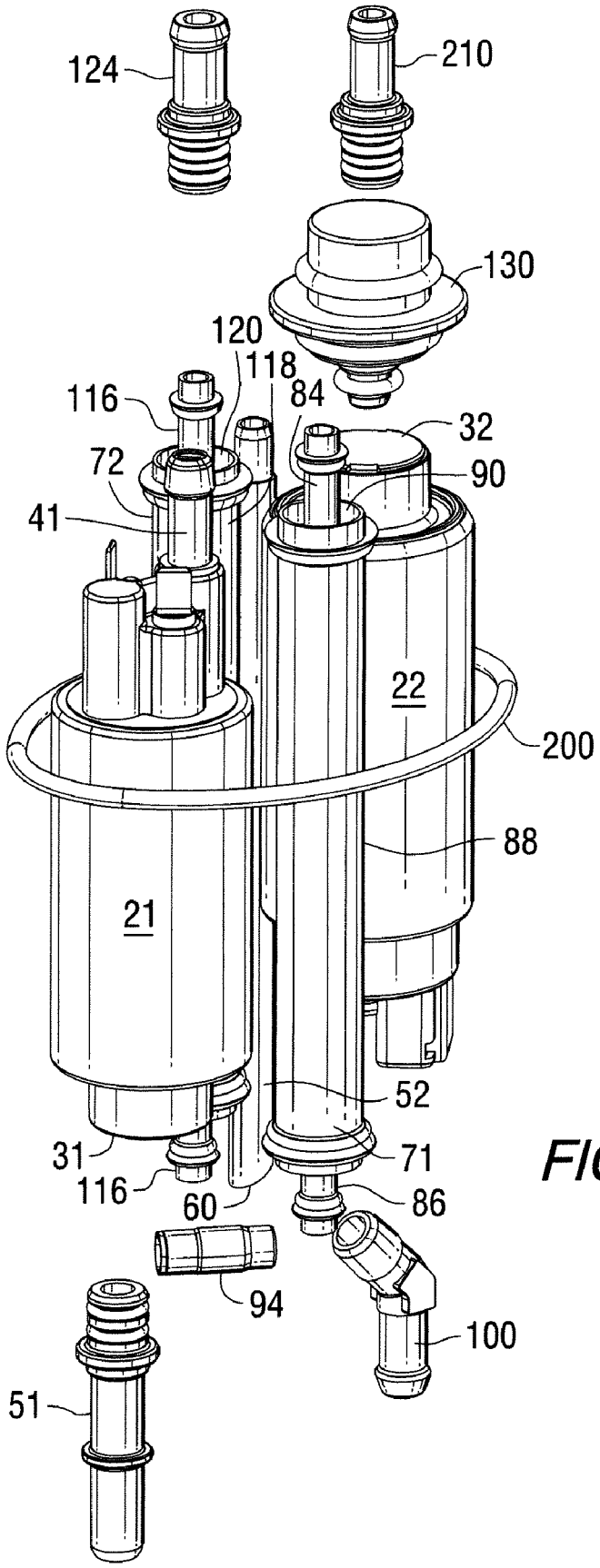
FIG. 3 is an isometric view of a fuel system used in a preferred embodiment of the present invention.

FIG. 3 is an isometric view of some of the components of a preferred embodiment of the present invention. For purposes of clarity, the housing container of the reservoir 10, illustrated in FIG. 1, has been removed from the illustration in FIG. 3. However, an O-ring 200 has been left in place to show the basic size of the housing. The position and size of the O-ring 200 illustrates the location and size of a mating face between a lower portion and an upper portion of the housing of the reservoir 10.

With continued reference to FIGS. 1-3, and particularly to FIG. 3, the first pump 21 and second pump 22 are illustrated with the two heat exchangers, 71 and 72, positioned between them. It should be understood that several components and structures have been removed from the illustration in FIG. 3 in order to more clearly identify the relative positions of other components that are more directly related to a preferred embodiment of the present invention and allow a more informative comparison between FIGS. 1 and 3. Some of these components which are not shown in FIG. 3 provide fluid connections between the illustrated components. However, by comparing FIGS. 1 and 3, the overall fuel and water circuits can be fully understood.

With continued reference to FIGS. 1 and 3, fuel is drawn upwardly through the first inlet conduit 51 by the first pump 21. This fuel flows through the first inlet 31 and out of the first outlet 41. After flowing upwardly through the first pump 21, the fuel is conducted to the inlet 84 of the first heat exchanger 71 and flows downwardly through the inner tube 86. From there, it flows through the regulator 94 and back to the first inlet 31. Water is conducted upwardly through conduit 100 and into the annular space 90 of the first heat exchanger 71. From there, it flows over to the annular space 120 of the second heat exchanger 72. Illustrated in FIG. 3 is the inner tube 116 of the second heat exchanger 72 and its outer tube 118. This water then flows downwardly through the annular space 120 and is returned to the body of water from which it was drawn. With continued reference to FIGS. 1 and 3, fuel is drawn upwardly into the primary opening 60 of the second inlet conduit 52 and into the second inlet 32 of the second fuel pump 22. This fuel is pumped downwardly by the second fuel pump 22 and directed toward the lower end of the inner tube 116 of the second heat exchanger 72. The fuel flows upwardly through the inner tube 116 and through conduit 124 to the fuel rail 138. Regulator 130 controls the flow of fuel through the second fuel circuit and uses intake manifold pressure, through conduit 210, as a reference pressure in order to regulate the pressure in the fuel rail relative to manifold pressure.

Figure 4:
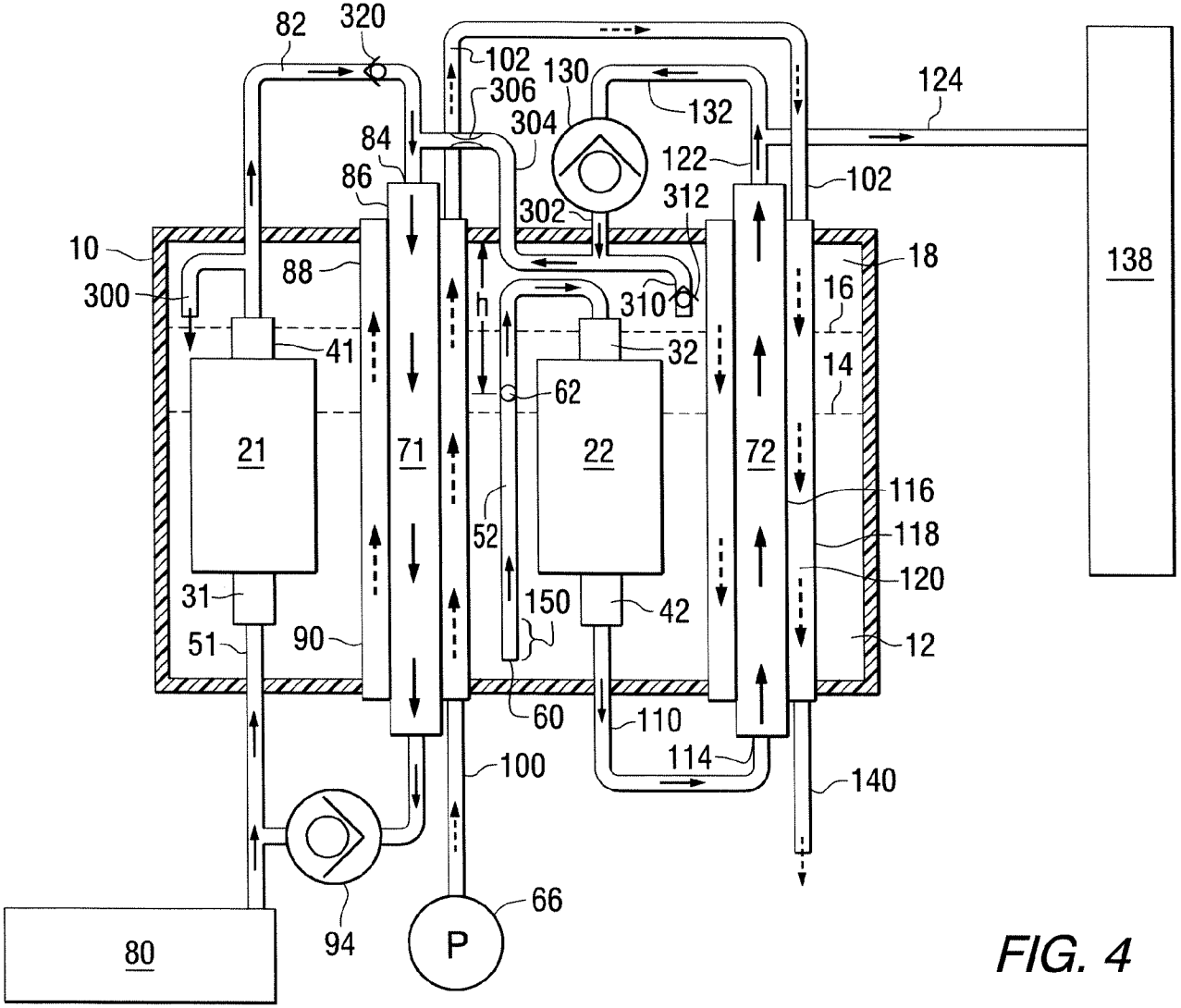
FIG. 4 illustrates a variation of the fuel system shown in FIG. 1 which is intended to improve the performance of a fuel system in the event that the fuel in the fuel tank 80 is depleted.
Figure 5:
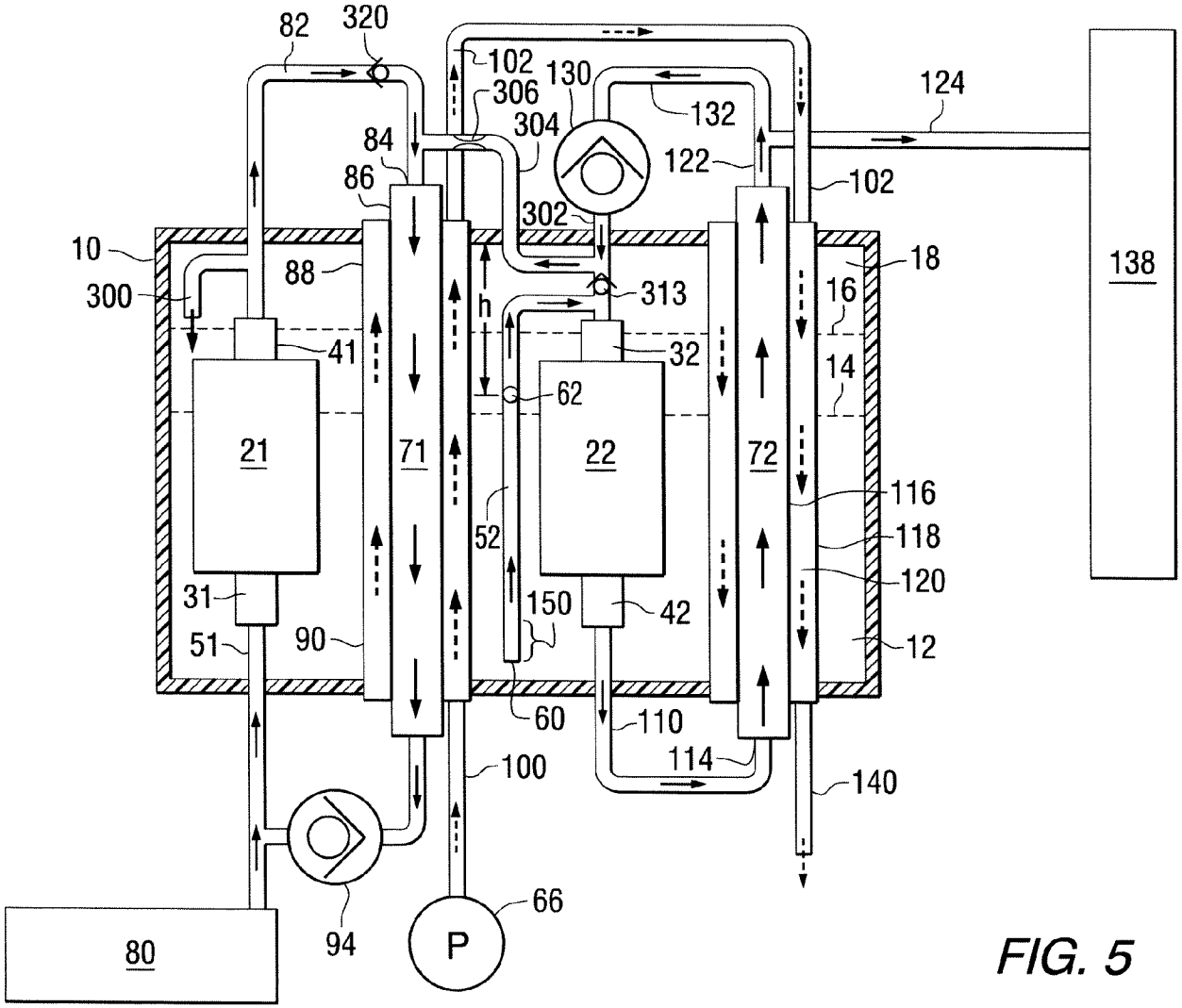
FIG. 5 illustrates another variation of the fuel system shown in FIG. 1 which is generally similar to the variation shown in FIG. 4, but with modifications to change the operating characteristics of the fuel system in the event that the fuel in fuel tank 80 is depleted.

FIGS. 4 and 5 illustrate certain modifications to the fuel system described above in conjunction with FIG. 1. Comparing FIGS. 4 and 5 to FIG. 1, it can be seen that conduit 96 in FIG. 1 has been removed and its basic function is performed by conduit 300 in the embodiments of the present invention shown in FIGS. 4 and 5. In addition, the outlet 302 of the regulator 130 is now connected to conduit 82 by conduit 304. In addition, orifice 306 is provided within conduit 304 as shown in FIGS. 4 and 5. The embodiments shown in FIGS. 4 and 5 differ from each other in the specific manner in which the outlet flow from regulator 130 is directed into the reservoir 10. Those differences will be described in greater detail below.

In addition, dimension h is specifically shown in FIGS. 4 and 5. As discussed above, the magnitude of dimension h determines the size of the ullage in combination with other variables. Since the second fuel pump 22 will draw vapor through the secondary opening 62 in preference to drawing liquid through the primary opening 60, if vapor is available at the secondary opening, the position of the secondary opening 62 will play a significant role in the determination of the size of the ullage. In a preferred embodiment of the present invention, the diameter of the orifice, or secondary opening 62, is 0.036 inches and the diameter of the primary opening 60 is 0.25 inches. These particular dimensions are satisfactory in the preferred embodiments of the present invention described above, but it should be clearly understood that alternative magnitudes can be selected in other applications of fuel systems, depending on the sizes, positions, and operating characteristics of the various components.

The outlet 302 of the regulator 120, in FIG. 4, is connected to conduit 304 and to conduit 310 which is provided with a check valve 312 as shown. The primary function of check valve 312 is to control the direction of flow through conduit 310. In various embodiments of the present invention, the operating characteristic of check valve 312 can be selected to open at a pressure of between 70 kPa and 200 kPa. The orifice 306 and check valve 312 work in cooperation with each other to deliver fuel from the regulator 130 back to the reservoir 10 in a controlled manner. When the relative pressures within the conduits and reservoir urge a fuel flow from outlet 302 of the regulator 130 toward conduit 82, the orifice 306 controls the rate of that flow so that it does not exceed the capabilities and operating characteristics of the first fuel pump 21.

With continued reference to FIG. 4, it should be noted that all of the fuel entering the second inlet 32 of the second fuel pump 22 must flow through the second inlet conduit 52. This characteristic differs from the embodiment shown in FIG. 1 which also can provide a flow of fuel from the outlet of the regulator 130 directly to the second inlet 32 of the second fuel pump 22.

FIG. 5 differs from the embodiment shown in FIG. 4 by providing a direct connection between the outlet 302 of regulator 130 and the second inlet 32 of the second fuel pump 22. That connection allows fuel flow through check valve 313 when the relative magnitudes of pressure at the second inlet 32 and within conduit 304 allow this direction of flow. Orifice 306 serves a similar purpose to that described above in conjunction with FIG. 4. As can be seen in FIG. 5, conduit 304 is connected in fluid communication with both the second inlet conduit 52 and conduit 304, with check valve 313 disposed therebetween.

In both FIGS. 4 and 5, a check valve 320 is disposed in conduit 82 in order to govern the direction of flow of fuel through conduit 82. Check valve 320 assures that fuel flowing through conduit 304 from the regulator 130 will pass through the first heat exchanger 71 and not flow toward the first outlet 41 of the first pump 21.

Comparing FIGS. 4 and 5 to FIG. 1, it can be seen that conduit 96 shown in FIG. 1 is not present in FIG. 4 or 5. The basic function performed by conduit 96 in the fuel system of FIG. 1 is performed by conduit 300 which is shown connected to conduit 82 at a point within the reservoir 10 and above the first outlet 41.

With continued reference to FIGS. 4 and 5, it should be understood that the modifications to FIG. 1 which are represented in FIGS. 4 and 5 relate most specifically to the operational condition that occurs when the fuel in fuel tank 80 is depleted and no longer available to the first pump 21. Under that condition, it is likely that some amount of fuel will continue to be available within the reservoir 10 for provision to the fuel rail 138. Under this condition, the first pump 21 can be operated with no liquid passing through it. This can potentially result in damage to the first pump 21. The configuration of components described above in conjunction with FIGS. 4 and 5 are intended to address this circumstance.

In a preferred embodiment of the present invention, regulator 130 is selected to have an operating pressure of approximately 350 kPa, regulator 94 is selected to have an operating pressure of approximately 70 kPa, check valve 312 is selected to have an operating pressure of approximately 70 kPa to 200 kPa, check valve 320 is selected to have an operating pressure of less than 70 kPa and orifice 306 is selected to allow a minimal flow of fluid through conduit 304 with a purpose of providing sufficient flow of liquid fuel to the first pump 21 to avoid allowing it to run under completely dry conditions. Orifice 306 is sized to also avoid a large flow of liquid fuel through conduit 304 which would potentially exceed the capability of the first pump 21. The embodiments shown in FIGS. 4 and 5 include modifications, as described above, which are intended to be beneficial under circumstances where the fuel tank 80 is depleted of fuel. Under those circumstances, the fuel system in FIG. 1 could be considered less than optimal in certain applications and under certain conditions.

As described above, it can be seen that a marine engine fuel system, made according to the preferred embodiments of the present invention, comprises a reservoir 10 configured to contain a quantity of fuel 12, a first fuel pump 21 having a first inlet 31 and a first outlet 41, a first inlet conduit 51 connected in fluid communication with the first inlet 31, a second fuel pump 22 having a second inlet 32 and a second outlet 42, and a second inlet conduit 52 connected in fluid communication with the second inlet 32. In preferred embodiments of the present invention, the first and second fuel pumps are disposed within the reservoir 10.

In a preferred embodiment of the present invention, the first inlet conduit 51 is connected in fluid communication with a fuel tank 80 of a marine vessel and the first outlet 41 is connected in fluid communication with the liquid fuel 12 within the reservoir 10. The second inlet conduit 52 is connected in fluid communication with the reservoir 10 and the second outlet 42 is connected in fluid communication with the fuel rail 138. A primary opening 60 is located at a distal end 150 of the second inlet conduit 52 and the secondary opening 62 is an orifice located between the primary opening 60 and the second inlet 32. The second inlet conduit 52 is positioned to dispose the primary opening 60 within liquid fuel 12 and to dispose the secondary opening 62 in fluid communication with the vaporous fuel when both liquid and vaporous fuel exist within the reservoir 10. The second inlet conduit 52 is positioned, in a preferred embodiment of the present invention, to dispose the primary opening 60 closer to the second outlet 42 than to the second inlet 32.

In a preferred embodiment of the present invention, it further comprises a water pump 66, a first heat exchanger 71 having a first water circuit which is connected in fluid communication with the water pump 66 and disposed in thermal communication with a first fuel circuit, and a second heat exchanger 72 having a second water circuit which is connected in fluid communication with the water pump 66 and disposed in thermal communication with a second fuel circuit. The first fuel pump is connected in fluid communication with the first fuel circuit and the second fuel pump is connected in fluid communication with the second fuel circuit. The first water circuit is disposed in thermal communication between the first fuel circuit and the quantity of fuel 12 and the second water circuit is disposed in thermal communication between the second fuel circuit and the quantity of fuel 12 within the reservoir 10. The first and second heat exchangers, 71 and 72, are disposed within the reservoir 10 in a preferred embodiment of the present invention. The first inlet conduit 51 is connected in fluid communication with the fuel tank 80 of a marine vessel, the first outlet 41 is connected in fluid communication with the reservoir 10 and the second outlet 42 is connected in fluid communication with a fuel rail 138. The fuel system in a preferred embodiment of the present invention is configured to inhibit fuel from flowing into the first inlet 31 after it has flowed into the quantity of fuel 12 within the reservoir 10. In addition, the fuel system in a preferred embodiment of the present invention is configured to inhibit fuel from flowing into the quantity of fuel 12 within the reservoir 10 after it has flowed out of the second outlet 42.

Although the present invention has been described in particular detail and illustrated to show several embodiments, it should be understood that alternative embodiments are also within its scope.

We claim:

1. A marine engine fuel system, comprising:

a reservoir configured to contain a quantity of fuel;

a first fuel pump having a first inlet and a first outlet;

a first inlet conduit connected in fluid communication with said first inlet;

a second fuel pump having a second inlet and a second outlet;

a second inlet conduit connected in fluid communication with said second inlet;

a primary opening formed in said second inlet conduit; and a secondary opening formed in said second inlet conduit, said primary and secondary openings being disposed within said reservoir, said secondary opening being disposed at a higher elevation than said primary opening, wherein fuel is supplied in a forward flow direction to said engine, and said second fuel pump is downstream of said first fuel pump along said forward flow direction.

2. The fuel system of claim 1, wherein:

said second fuel pump is disposed within said reservoir.

3. The fuel system of claim 2, wherein:

said first fuel pump is disposed within said reservoir.

4. The fuel system of claim 1, wherein:

said first inlet conduit is connected in fluid communication with a fuel tank of a marine vessel; and said first outlet is connected in fluid communication with said reservoir.

5. The fuel system of claim 1, wherein:

said second inlet conduit is connected in fluid communication with said reservoir; and said second outlet is connected in fluid communication with a fuel rail.

6. The fuel system of claim 1, wherein:

said primary opening is located at a distal end of said second inlet conduit.

7. The fuel system of claim 6, wherein:

said secondary opening is an orifice located between said primary opening and said second inlet.

8. The fuel system of claim 1, wherein:

said second inlet conduit is positioned to dispose said primary opening within liquid fuel and to dispose said secondary opening in fluid communication with vaporous fuel when both liquid and vaporous fuel exist within said reservoir.

9. The fuel system of claim 1, wherein:

said second inlet conduit is positioned to dispose said primary opening closer to said second outlet than to said second inlet.

10. A marine engine fuel system, comprising:

a reservoir configured to contain a quantity of fuel;

a first fuel pump having a first inlet and a first outlet, said first fuel pump being disposed within said reservoir;

a first inlet conduit connected in fluid communication with said first inlet;

a second fuel pump having a second inlet and a second outlet, said second fuel pump being disposed within said reservoir;

a second inlet conduit connected in fluid communication with said second inlet;

a primary opening formed in said second inlet conduit; and a secondary opening formed in said second inlet conduit, said primary and secondary openings being disposed within said reservoir, said secondary opening being disposed at a higher elevation than said primary opening, wherein fuel is supplied in a forward flow direction to said engine, and said second fuel pump is downstream of said first fuel pump along said forward flow direction.

11. The fuel system of claim 10, wherein:

said first inlet conduit is connected in fluid communication with a fuel tank of a marine vessel; and said first outlet is connected in fluid communication with said reservoir.

12. The fuel system of claim 11, wherein:

said second inlet conduit is connected in fluid communication with said reservoir; and said second outlet is connected in fluid communication with a fuel rail.

13. The fuel system of claim 12, wherein:

said primary opening is located at a distal end of said second inlet conduit.

14. The fuel system of claim 13, wherein:

said secondary opening is an orifice located downstream from said primary opening and upstream from said second inlet.

15. The fuel system of claim 10, wherein:

said second inlet conduit is positioned to dispose said primary opening within liquid fuel and to dispose said secondary opening in fluid communication with vaporous fuel when both liquid and vaporous fuel exist within said reservoir.

16. The fuel system of claim 10, wherein:

said second inlet conduit is positioned to dispose said primary opening closer to said second outlet than to said second inlet.

17. A marine engine fuel system, comprising:

a reservoir configured to contain a quantity of fuel;

a first fuel pump having a first inlet and a first outlet;

a first inlet conduit connected in fluid communication with said first inlet;

a second fuel pump having a second inlet and a second outlet;

a second inlet conduit connected in fluid communication with said second inlet;

a primary opening formed in said second inlet conduit; and a secondary opening formed in said second inlet conduit, said primary and secondary openings being disposed within said reservoir, said secondary opening being disposed at a higher elevation than said primary opening, said second inlet conduit being positioned to dispose said primary opening within liquid fuel and to dispose said secondary opening in fluid communication with vaporous fuel when both liquid and vaporous fuel exist within said reservoir, wherein fuel is supplied in a forward flow direction to said engine, and said second fuel pump is downstream of said first fuel pump along said forward flow direction.

18. The fuel system of claim 17, wherein:

said second fuel pump is disposed within said reservoir; and said first fuel pump is disposed within said reservoir.

19. The fuel system of claim 17, wherein:

said first inlet conduit is connected in fluid communication with a fuel tank of a marine vessel;

said first outlet is connected in fluid communication with said reservoir;

said second inlet conduit is connected in fluid communication with said reservoir; and said second outlet is connected in fluid communication with a fuel rail.

20. The fuel system of claim 17, wherein:

said second inlet conduit is positioned to dispose said primary opening closer to said second outlet than to said second inlet.

* * * * *